US007762873B2

(12) United States Patent
Feng et al.

(10) Patent No.: US 7,762,873 B2
(45) Date of Patent: Jul. 27, 2010

(54) ULTRA FINE FIBER POLISHING PAD

(75) Inventors: Chung-Chih Feng, Sanmin (TW); Chen-Hsiang Chao, Zuoying (TW); I-Peng Yao, Sanmin (TW)

(73) Assignee: San Fang Chemical Industry Co., Ltd., Jenwu Shiang (TW)

( * ) Notice: Subject to any disclaimer, the term of this patent is extended or adjusted under 35 U.S.C. 154(b) by 2 days.

(21) Appl. No.: 12/119,580

(22) Filed: May 13, 2008

(65) Prior Publication Data

US 2008/0227375 A1 Sep. 18, 2008

Related U.S. Application Data

(62) Division of application No. 11/369,139, filed on Mar. 6, 2006, now abandoned.

(30) Foreign Application Priority Data

May 27, 2005 (TW) ..... 94117355 A

(51) Int. Cl.
*B24D 11/00* (2006.01)

(52) U.S. Cl. ..... 451/532; 51/297; 428/172; 451/533; 451/550

(58) Field of Classification Search ..... 428/171, 428/221, 172; 442/59, 104, 153, 334, 340; 451/532, 526, 533, 550; 51/297, 298
See application file for complete search history.

(56) References Cited

U.S. PATENT DOCUMENTS

| | | | |
|---|---|---|---|
| 2,116,289 A | 5/1938 | Shepherd | 118/212 |
| 3,383,273 A | 5/1968 | Roland et al. | 442/352 |
| 3,531,368 A | 9/1970 | Okamoto et al. | |
| 3,590,112 A | 6/1971 | Civardi | 264/321 |
| 3,716,614 A | 2/1973 | Okamoto et al. | 264/49 |
| 3,835,212 A | 9/1974 | Piacente | 264/76 |

(Continued)

FOREIGN PATENT DOCUMENTS

| | | |
|---|---|---|
| CN | 1346912 | 5/2002 |

(Continued)

OTHER PUBLICATIONS

Mesh Size and Micron Size: Coral Calcium Absorption. Internet Reference. URL:www.healthtreasures.com/mesh-microns.html.

*Primary Examiner*—Timothy V Eley
(74) *Attorney, Agent, or Firm*—Alan Kamrath; Kamrath & Associates PA

(57) ABSTRACT

A polishing pad includes a body having a polymer layer and a polishing layer. The polymer layer has opposite first and second faces. The polymer layer includes a plurality of first ultrafine fibers and a polymer bonding the first ultrafine fibers together. The polishing layer is formed on the first face of the polymer layer. The polishing layer includes a plurality of second ultrafine fibers and is free of the polymer. The first and second ultrafine fibers are identical to each other. The second ultrafine fibers have a first concentration of ultrafine fibers by volume higher than 80% a total volume of the polishing layer. The first ultrafine fibers of the polymer layer have a second concentration of ultrafine fibers by volume to a total volume of the polymer layer. The first concentration is higher than the second concentration.

2 Claims, 7 Drawing Sheets

U.S. PATENT DOCUMENTS

| | | | | |
|---|---|---|---|---|
| 3,841,897 | A | 10/1974 | Okazaki et al. | 428/151 |
| 3,865,678 | A | 2/1975 | Okamoto et al. | 428/91 |
| 3,900,549 | A | 8/1975 | Yamane et al. | 264/172.13 |
| 3,989,869 | A | 11/1976 | Neumaier et al. | 442/226 |
| 4,018,954 | A | 4/1977 | Fukushima et al. | 428/86 |
| 4,045,598 | A | 8/1977 | Henson | 427/296 |
| 4,067,833 | A | 1/1978 | Austin et al. | 521/164 |
| 4,096,104 | A | 6/1978 | Spain et al. | 427/227 |
| 4,145,468 | A | 3/1979 | Mizoguchi et al. | 428/239 |
| 4,216,251 | A | 8/1980 | Nishimura et al. | 427/370 |
| 4,250,308 | A | 2/1981 | Goedecke et al. | 544/190 |
| 4,259,384 | A | 3/1981 | Veiga et al. | 428/97 |
| 4,342,805 | A | 8/1982 | McCartney | 428/151 |
| 4,363,845 | A | 12/1982 | Hartmann | 428/198 |
| 4,433,095 | A | 2/1984 | Hombach et al. | 524/563 |
| 4,476,186 | A | 10/1984 | Kato et al. | 442/60 |
| 4,587,142 | A | 5/1986 | Higuchi et al. | 428/15 |
| 4,708,839 | A | 11/1987 | Bellet et al. | 264/85 |
| 4,728,552 | A | 3/1988 | Jensen, Jr. | 428/91 |
| 4,841,680 | A | 6/1989 | Hoffstein et al. | 51/283 |
| 4,927,432 | A | 5/1990 | Budinger et al. | 51/298 |
| 4,954,141 | A | 9/1990 | Takiyama et al. | 51/296 |
| 4,966,808 | A | 10/1990 | Kawano | 442/201 |
| 4,997,876 | A | 3/1991 | Scarso | 524/706 |
| 5,020,283 | A | 6/1991 | Tuttle | 51/209 |
| 5,094,670 | A | 3/1992 | Imada | 51/293 |
| 5,124,194 | A | 6/1992 | Kawano | 442/201 |
| 5,197,999 | A | 3/1993 | Thomas | 51/298 |
| 5,212,910 | A | 5/1993 | Breivogel et al. | 51/398 |
| 5,216,843 | A | 6/1993 | Breivogel et al. | 51/131.1 |
| 5,225,267 | A | 7/1993 | Ochi et al. | 428/214 |
| 5,242,750 | A | 9/1993 | Wagner et al. | 428/316.6 |
| 5,290,626 | A | 3/1994 | Nishioi et al. | 442/201 |
| 5,297,364 | A | 3/1994 | Tuttle | 51/209 |
| 5,394,655 | A | 3/1995 | Allen et al. | 451/63 |
| 5,482,756 | A * | 1/1996 | Berger et al. | 428/36.2 |
| 5,484,646 | A | 1/1996 | Mann | 428/198 |
| 5,489,233 | A | 2/1996 | Cook et al. | 451/41 |
| 5,503,899 | A | 4/1996 | Ashida et al. | 428/151 |
| 5,510,175 | A | 4/1996 | Shiozawa | 442/77 |
| 5,518,800 | A | 5/1996 | Okawa et al. | 428/151 |
| 5,533,923 | A | 7/1996 | Shamouilian et al. | 451/41 |
| 5,554,064 | A | 9/1996 | Breivogel et al. | 451/41 |
| 5,562,530 | A | 10/1996 | Runnels et al. | 451/36 |
| 5,611,943 | A | 3/1997 | Cadien et al. | 216/88 |
| 5,662,966 | A | 9/1997 | Kobayashi | 427/385.5 |
| 5,733,635 | A * | 3/1998 | Terakawa et al. | 428/198 |
| 5,993,943 | A | 11/1999 | Bodaghi et al. | 428/198 |
| 6,089,965 | A | 7/2000 | Otawa et al. | 451/527 |
| 6,159,581 | A | 12/2000 | Yoneda et al. | 428/195 |
| 6,322,851 | B1 | 11/2001 | Adachi et al. | 427/246 |
| 6,383,066 | B1 * | 5/2002 | Chen et al. | 451/532 |
| 6,451,404 | B1 | 9/2002 | Nobuto et al. | 428/91 |
| 6,451,716 | B1 | 9/2002 | Sasaki et al. | 442/77 |
| 6,468,651 | B2 | 10/2002 | Aikawa et al. | 428/364 |
| 6,479,153 | B1 | 11/2002 | Kato et al. | 428/423.7 |
| 6,515,223 | B2 | 2/2003 | Tashjian | 174/35 R |
| 6,517,938 | B1 | 2/2003 | Andoh et al. | 428/395 |
| 6,528,139 | B2 | 3/2003 | Hoyt et al. | 428/97 |
| 6,533,645 | B2 * | 3/2003 | Tolles | 451/41 |
| 6,613,867 | B2 | 9/2003 | Sonnenschein et al. | 528/76 |
| 6,767,853 | B1 | 7/2004 | Nakayama et al. | 442/361 |
| 6,852,392 | B2 | 2/2005 | Kikuchi et al. | 428/166 |
| 6,852,418 | B1 | 2/2005 | Zurbig et al. | 428/423.1 |
| 6,860,802 | B1 | 3/2005 | Vishwanathan et al. | 451/527 |
| 6,964,604 | B2 * | 11/2005 | Chen et al. | 451/532 |
| 7,025,915 | B2 | 4/2006 | Wang et al. | 264/103 |
| 2002/0013984 | A1 | 2/2002 | Makiyama et al. | 28/103 |
| 2002/0098756 | A1 | 7/2002 | Sasaki et al. | 442/77 |
| 2004/0045145 | A1 | 3/2004 | Wang et al. | 28/168 |
| 2004/0063370 | A1 | 4/2004 | Makiyama et al. | 442/363 |
| 2004/0142148 | A1 | 7/2004 | Feng et al. | 428/151 |
| 2004/0162013 | A1 * | 8/2004 | Chen et al. | 451/526 |
| 2004/0191412 | A1 | 9/2004 | Wang et al. | 427/245 |
| 2004/0253404 | A1 | 12/2004 | Wang et al. | 428/41.8 |
| 2005/0100710 | A1 | 5/2005 | Feng et al. | 428/151 |
| 2005/0244654 | A1 | 11/2005 | Wang et al. | 428/423.1 |
| 2005/0260416 | A1 | 11/2005 | Wang et al. | 428/423.1 |
| 2006/0046597 | A1 | 3/2006 | Wang et al. | 442/394 |
| 2006/0057432 | A1 | 3/2006 | Feng et al. | 428/904 |
| 2006/0147642 | A1 | 7/2006 | Wang et al. | 427/430.1 |
| 2006/0160449 | A1 | 7/2006 | Wang et al. | 442/182 |
| 2006/0218729 | A1 | 10/2006 | Feng | 8/94.15 |
| 2006/0249244 | A1 | 11/2006 | Wang et al. | 156/239 |
| 2006/0263601 | A1 | 11/2006 | Wang et al. | 428/373 |
| 2006/0272770 | A1 | 12/2006 | Lee et al. | 156/322 |
| 2007/0155268 | A1 * | 7/2007 | Feng et al. | 442/103 |

FOREIGN PATENT DOCUMENTS

| | | |
|---|---|---|
| DE | 3536371 | 5/1987 |
| DE | 10100814 | 7/2001 |
| EP | 1054096 | 11/2000 |
| JP | 52047896 | 4/1977 |
| JP | 05117584 | 5/1993 |
| JP | 06192969 | 7/1994 |
| JP | 08291454 | 11/1996 |
| JP | 09059881 | 3/1997 |
| JP | 11093082 | 4/1999 |
| JP | 2000248431 | 9/2000 |
| KR | 2002004295 | 1/2002 |
| WO | WO9615887 | 5/1996 |
| WO | WO0002707 | 1/2000 |
| WO | WO2004/044028 | 5/2004 |

* cited by examiner

ULTRA FINE FIBER POLISHING PAD

CROSS REFERENCE TO RELATED APPLICATION

This is a divisional application of U.S. patent application Ser. No. 11/369,139 filed Mar. 6, 2006, now abandoned.

BACKGROUND OF INVENTION

1. Field of the Invention

The present invention relates to a polishing pad for polishing the surfaces of objects such as semiconductors, storage medium substrates, integrated circuits and electro-optical panels, and relates to a method for making the polishing pad.

2. Related Prior Art

In the semiconductor industry, there is a trend toward the reduction of the semiconductor characteristics and the increasing of the superficial planarity. In detail, it is preferred to provide a surface with an even form by reducing the quantity and size of superficial flaws.

Polishing is often used to turn a rough surface into a smooth surface. Amid other polishing methods, there are fixed-type polishing methods and suspension-type polishing methods.

In a fixed-type polishing method, used is a fixed-type polishing pad with a polishing layer on a substrate. The substrate is a PET foil for example. The polishing layer includes polishing particles and an adhesive for fixing the polishing particles to the substrate. Although providing a high polishing rate, the fixed-type polishing pad causes grave impacts on the polished surface, and it is difficult to clean the polished surface of debris. Hence, many large and deep scratches are made in the polished surface, and this is not desirable.

In a suspension-type polishing method, used is a suspension-type polishing pad with a polishing solution on a substrate. The polishing solution is a suspension with polishing particles suspended in a solvent. For the use of the solvent, it is easy to clean the polished surface of debris. As suspended in the solvent, the polishing particles freely move. Hence, the impacts on the polished surface by the suspended polishing particles can readily be adjusted. Moreover, it is easy to control the result by changing the suspension-type polishing pad. Various velvets and fabrics are used in the suspension-type polishing pad to achieve adequate effects according to different purposes.

In the suspension-type polishing method, the polishing solution is provided between the substrate and the polished surface, and the substrate is regularly rotated related to the polished surface. The substrate of the suspension-type polishing pad may include urethane or polyurethane plastics filled in a blanket made of polyester. Alternatively, the blanket may be made of natural fibers such as wool.

Chemical mechanical polishing ("CMP") is often used in a typical machine for polishing semiconductor devices. In a CMP method, a polishing pad includes a polishing solution on a substrate. The polishing pad is used to polish the surfaces of semiconductor devices. The polishing solution is provided between a wafer and the substrate, and the wafer is pressed on and rotated relative to the polishing pad while chemical substances in the polishing solution and the pressure and rate between the wafer and the polishing pad and temperature are under control. The polishing solution includes polishing particles capable of mechanically polishing the surface of the wafer when mixed with the chemical substances. Between the chemical substances and the surface of the wafer, chemical reactions such as removal and oxidation happen. The polishing pad often includes a continuous substrate. When the wafer is rotated relative to the polishing pad, some redundant material is mechanically removed from the surface of the wafer by the polishing particles of the polishing liquid while some other redundant material is chemically removed from the surface of the wafer by the solvent of the polishing liquid.

Disclosed in US Patent Application Publication 2002/0013984A1 is a sheet for texturing and a method of producing the same. The method includes four steps among which the second and third steps can be interchanged.

Firstly, a non-woven fabric is composed of ultrafine fiber-generating fibers (a) and (b).

Secondly, an elastomer is filled in the non-woven fabric so as to form a sheet.

Thirdly, the ultrafine fiber-generating fibers (a) are converted to bundles of ultrafine fibers while the ultrafine fiber-generating fibers (b) are converted to bundles of ultrafine fibers not more than 0.03 dtex in fineness.

Fourthly, at least one side of the sheet is ground so that the ultrafine fibers under 0.03 dtex in fineness form nap.

A polishing layer is formed on the side of the sheet on which the nap is formed. However, in the step of converting the fibers (a) and (b) to the ultrafine fibers, since the polishing layer includes the polymer and the fibers, the polishing layer cannot adequately be opened so that the nap is not fine enough and that the nap may get entangled. If the polishing layer contains too much polymer, when it is used to polish an object, particles (polishing synthetic materials, sheet materials, polishing particles, particles of sheet materials and debris of the object) will stick to the polymer of the polishing layer and cannot smoothly be removed by a polishing solution. These redundant particles will wear away the object and jeopardize the polishing of the object.

The present invention is therefore intended to obviate or at least alleviate the problems encountered in the prior art.

SUMMARY OF INVENTION

It is the primary objective of the present invention to provide a polishing pad with ultrafine fibers that are highly opened and therefore do not cause damages to an object.

A polishing pad according to the preferred teachings of the present invention includes a body having a polymer layer with opposite first and second faces and a polishing layer on the first face of the polymer layer. The polymer layer includes a plurality of first ultrafine fibers and a polymer bonding the first ultrafine fibers together. The polishing layer includes a plurality of second ultrafine fibers and is free of the polymer. The first and second ultrafine fibers are identical to each other. The second ultrafine fibers have a concentration of ultrafine fibers by volume higher than 80% of a total volume of the polishing layer. The first ultrafine fibers of the polymer layer have a second concentration of ultrafine fibers by volume to a total volume of the polymer layer. The first concentration is higher than the second concentration.

Preferably, the second ultrafine fibers in the polishing layer have a fineness lower than 0.05 dtex.

The polishing pad can be used to polish any substrate made of glass, metal, metal oxide, metal alloy or semi-conductor or any combination thereof.

The substrate may include any proper metal such as copper, aluminum, tantalum, titanium, tungsten, gold, platinum, iridium, ruthenium and any combination thereof such as alloy and mixture.

The substrate may include any proper metal oxide such as aluminum oxide, silicon oxide, titanium oxide, cerium oxide, zirconium oxide, germanium oxide, magnesium oxide and any combination thereof.

The substrate may include any proper metal alloy such as metal nitride (such as tantalum nitride, titanium nitride and tungsten nitride), metal carbide (such as silicone carbide and tungsten carbide), nickel-phosphorous, aluminum-silicone-boron, silicone-boron glass, silicone-phosphorous glass, silicone-phosphorous-boron glass, silicone-germanium alloy, silicone-germanium-carbon alloy.

The substrate may include any proper semi-conductor such as mono-crystalline silicone, multi-crystalline silicone, amorphous silicone, silicon-on-insulator and gallium arsenide.

Other objectives, advantages and features of the present invention will become apparent from the following description referring to the drawings.

BRIEF DESCRIPTION OF DRAWINGS

A polishing pad according to the preferred embodiment of the present invention will be described referring to the drawings.

DETAILED DESCRIPTION OF EMBODIMENTS

In a method to manufacture a polishing pad according to the preferred teachings of the present invention, ultrafine fiber-generating fibers are made into a non-woven fabric with two sides. At least one of the sides of the non-woven fabric is made a dense layer. The non-woven fabric is coated with a polymer such as a polyurethane resin, a polyvinylchloride resin, a polystyrene resin, a polyvinyl resin, a polyamide resin, a propylene resin and a vinyl-vinylacetate resin. Because of the dense layer, the polymer cannot penetrate the non-woven fabric.

The dense layer can be made by heating the side of the non-woven fabric at a temperature higher than 100 degrees Celsius so that the surfaces of the ultrafine fiber-generating fibers are transformed and made dense. While being heated, the side of the non-woven fabric can be pressed.

Alternatively, the dense layer can be made by coating the non-woven fabric with a dissolvable substance such as polyvinyl alcohol, methyl cellulose, sodium bicarbonate and amylase. The concentration of the dissolvable substance is 5% to 15% and provided with a roller at 100 to 200 g/m$^2$. Thus, when the polymer is coated on the non-woven fabric, the polymer cannot penetrate the non-woven fabric since the dissolvable substance has occupied the superficial space. The dissolvable substance can be washed away with water.

The ultrafine fiber-generating fibers are converted to ultrafine fibers. Since the dense layer prevents the polymer from penetrating the ultrafine fiber-generating fibers, the ultrafine fibers includes a high concentration of fiber. The ultrafine fibers are transformed into nap. A polishing pad is completed. In use, the nap of a polishing layer of the polishing pad will not get entangled and cause damages to an object polished by the polishing pad.

Figure 3:
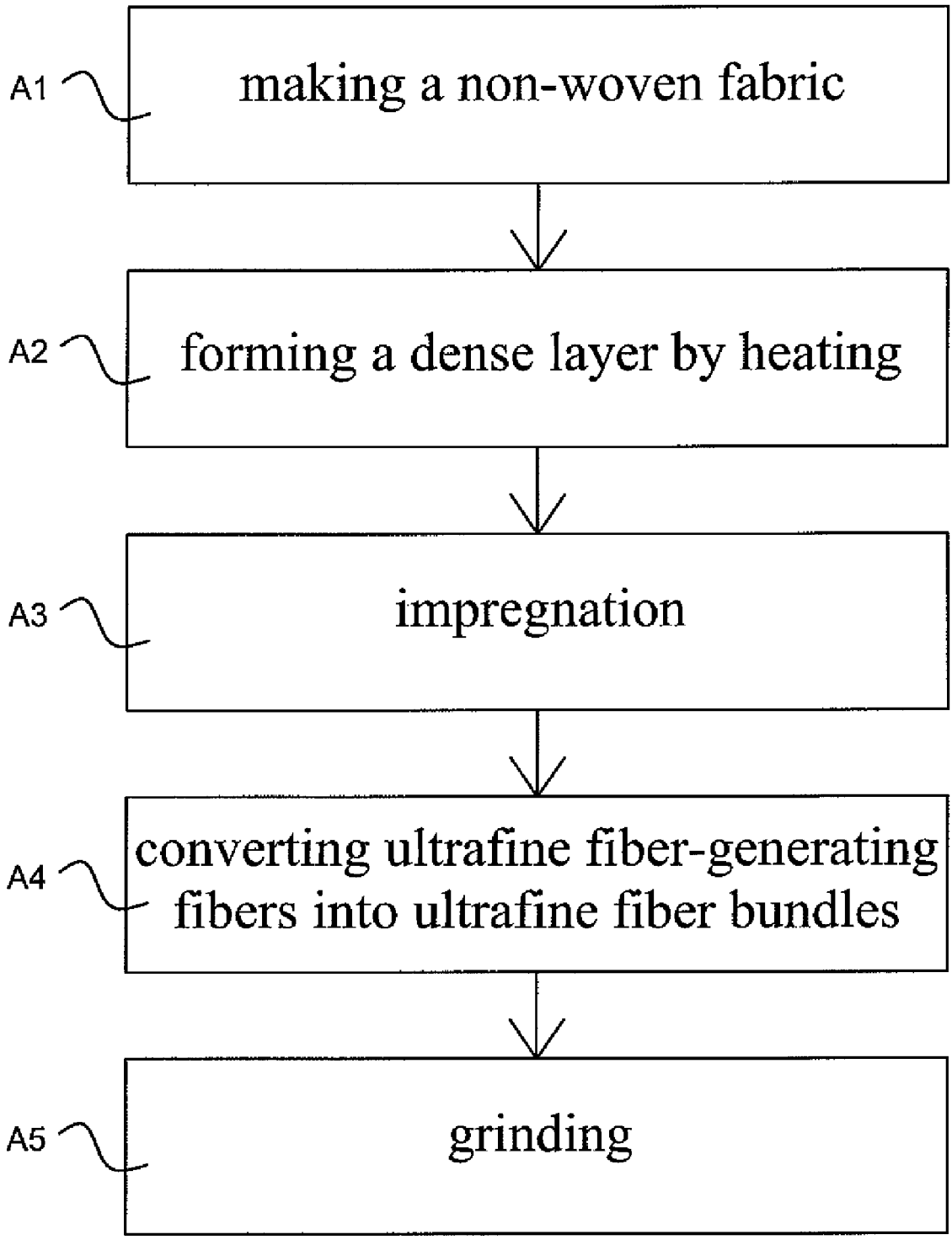
FIG. 3 shows a flowchart of a method of a first embodiment according to the preferred teachings of the present invention.
Figure 3A:
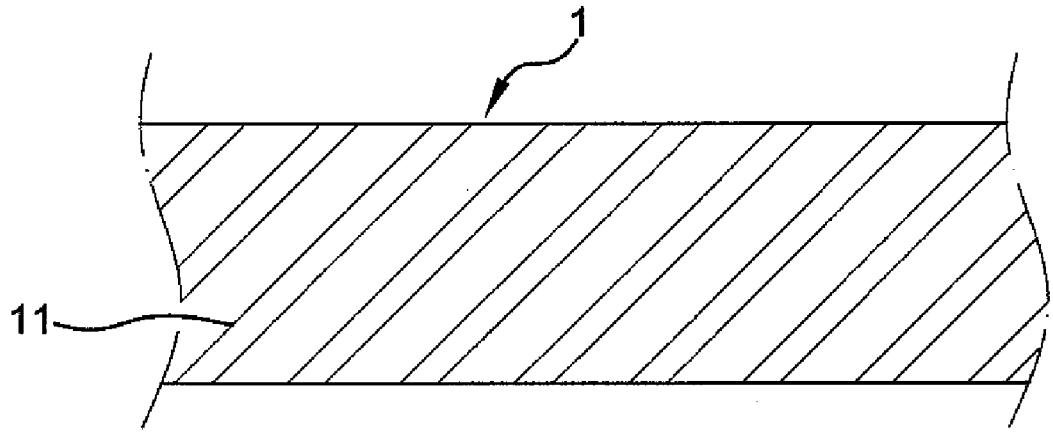
FIG. 3A shows a non-woven fabric formed after a first step of the method of FIG. 3.
Figure 3B:
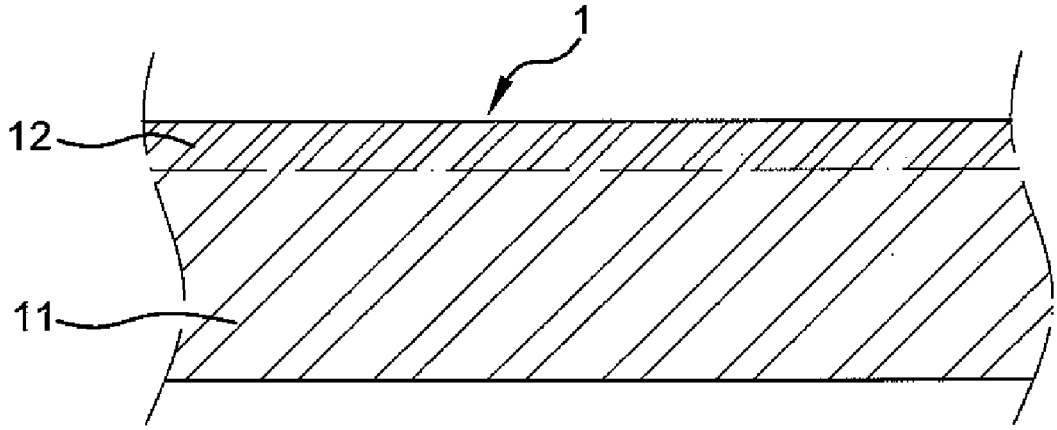
FIG. 3B shows the non-woven fabric of FIG. 3A after a second step of the method of FIG. 3.
Figure 3C:
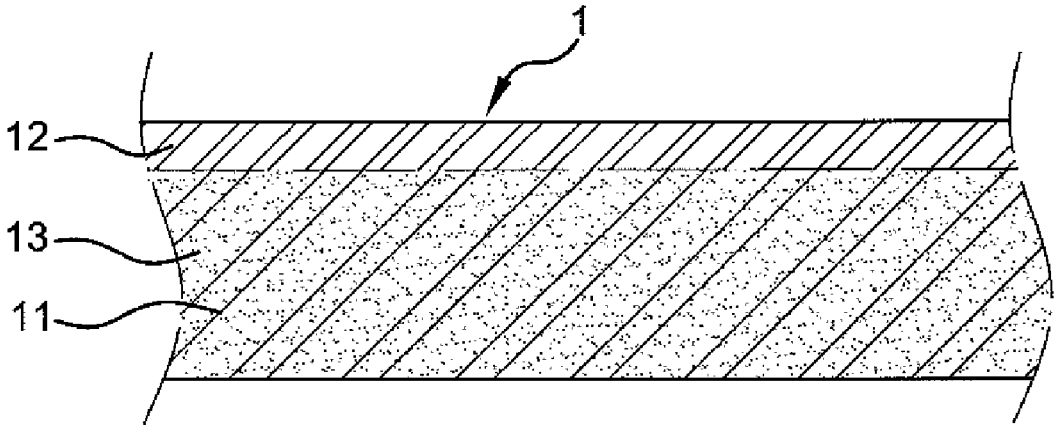
FIG. 3C shows the non-woven fabric of FIG. 3B after a third step of the method of FIG. 3.
Figure 3D:
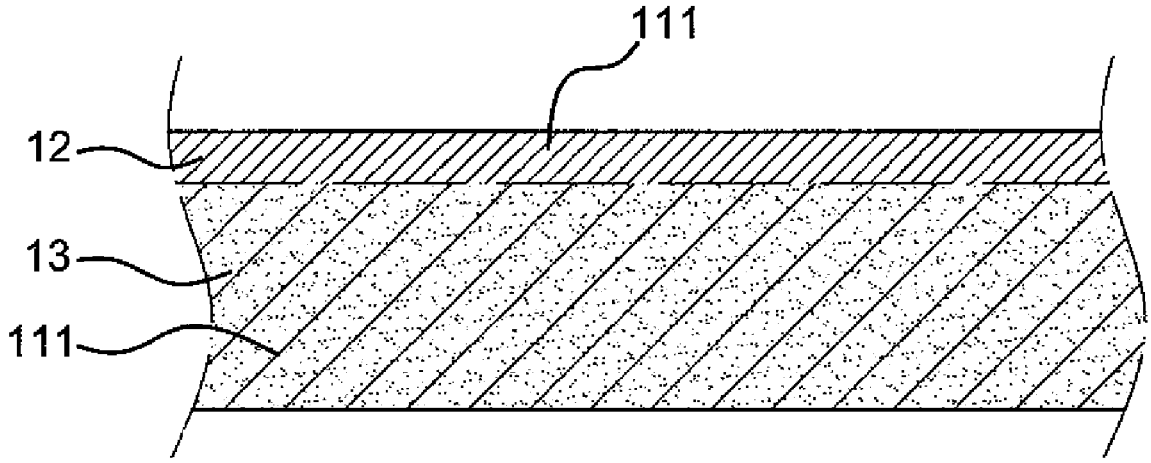
FIG. 3D shows the non-woven fabric of FIG. 3C after a fourth step of the method of FIG. 3.
Figure 3E:
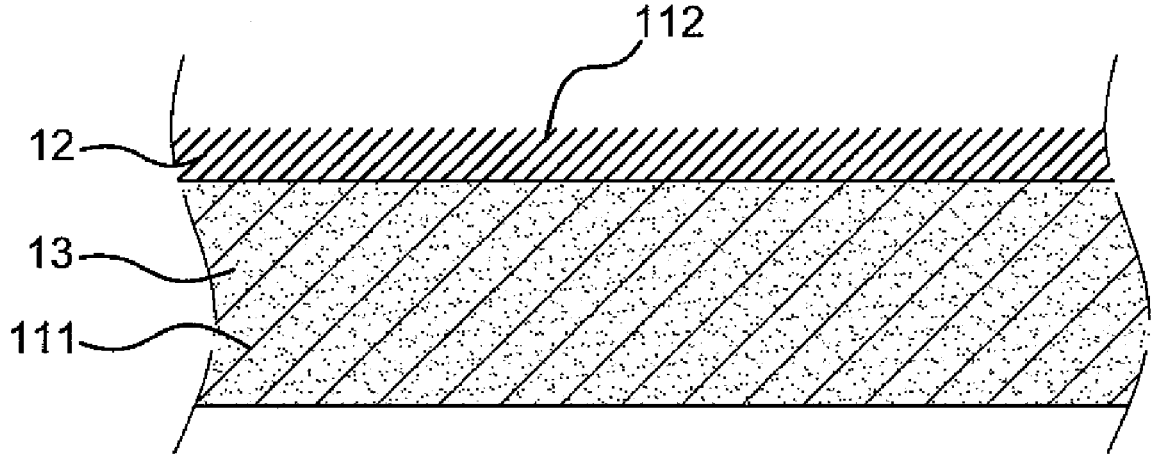
FIG. 3E shows a polishing pad after grinding the non-woven fabric of FIG. 3D.
Figure 4:
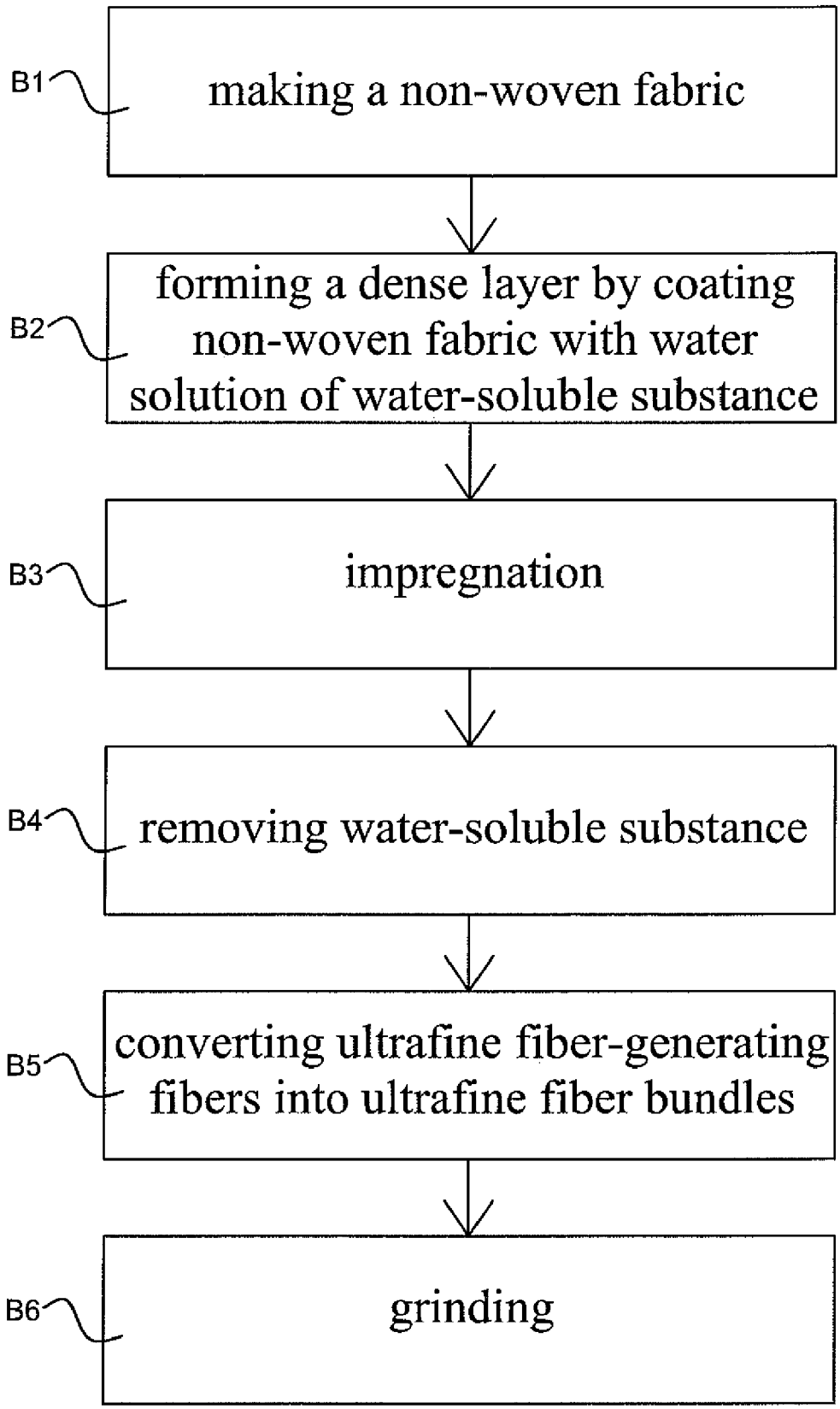
FIG. 4 shows a flowchart of a method of a second embodiment according to the preferred teachings of the present invention.
Figure 4A:
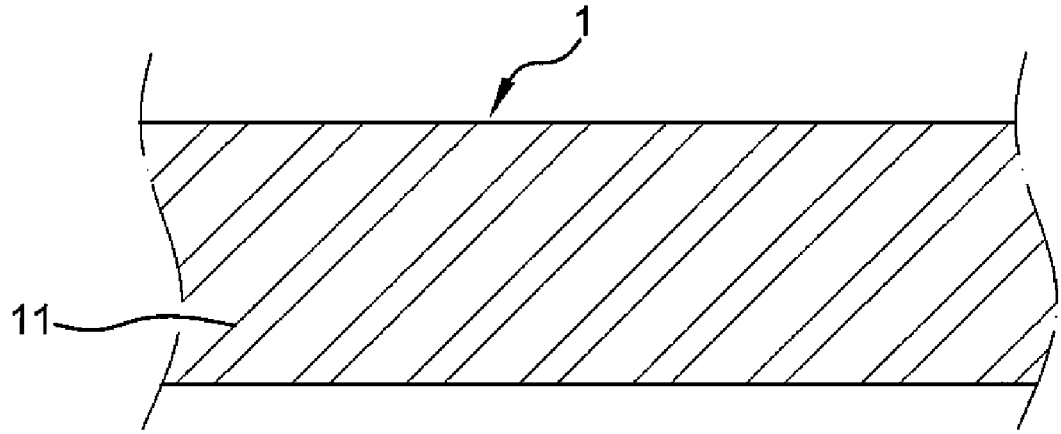
FIG. 4A shows a non-woven fabric formed after a first step of the method of FIG. 4.
Figure 4B:
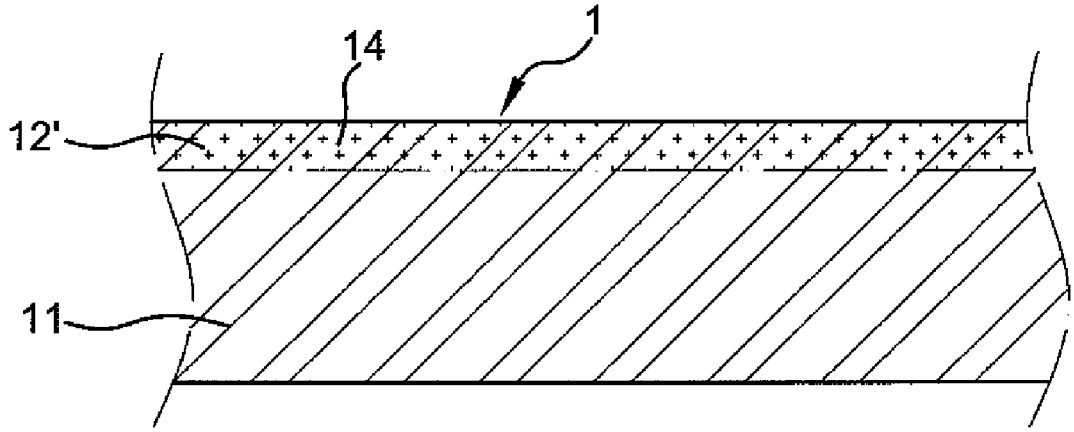
FIG. 4B shows the non-woven fabric of FIG. 4A after a second step of the method of FIG. 3.
Figure 4C:
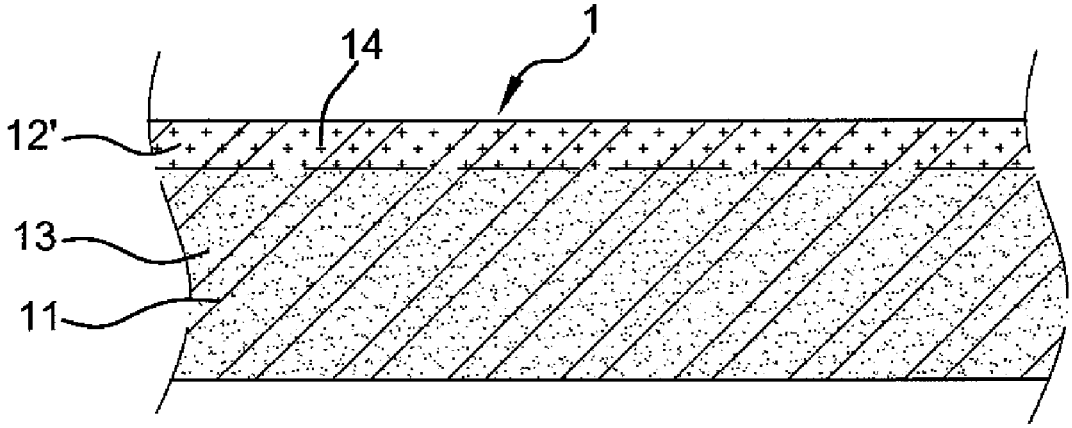
FIG. 4C shows the non-woven fabric of FIG. 4B after a third step of the method of FIG. 4.
Figure 4D:
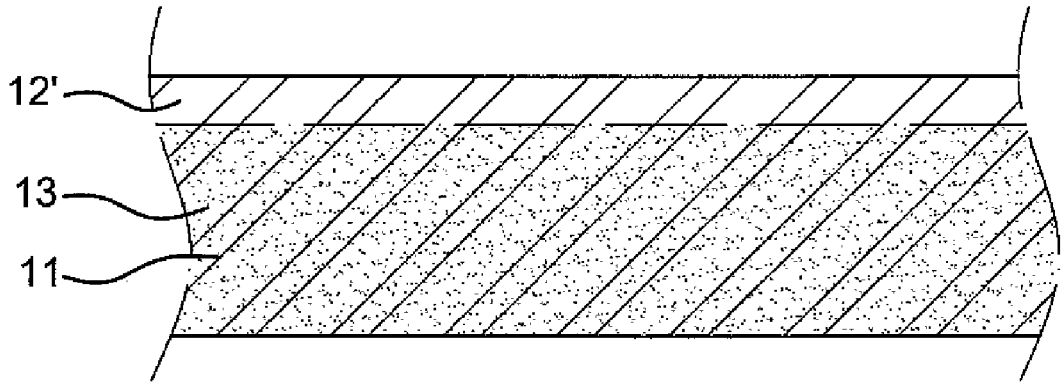
FIG. 4D shows the non-woven fabric of FIG. 4C after a fourth step of the method of FIG. 4.
Figure 4E:
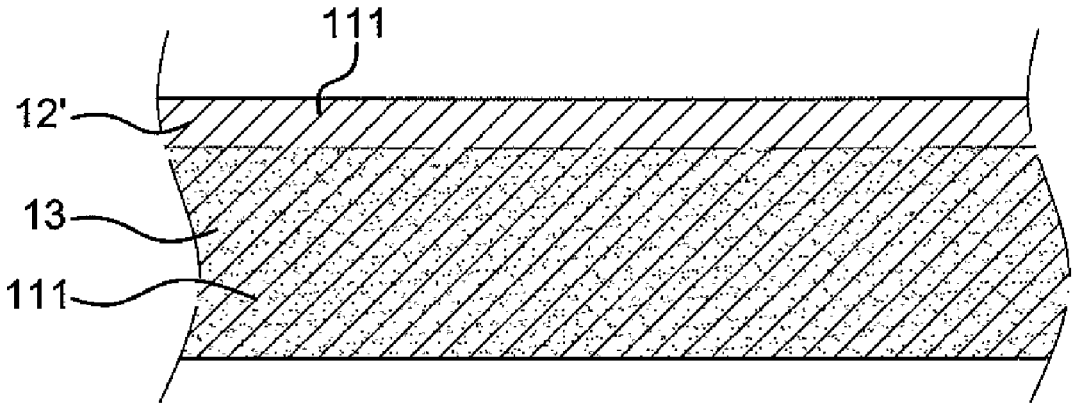
FIG. 4E shows the non-woven fabric of FIG. 4D after a fifth step of the method of FIG. 4.
Figure 4F:
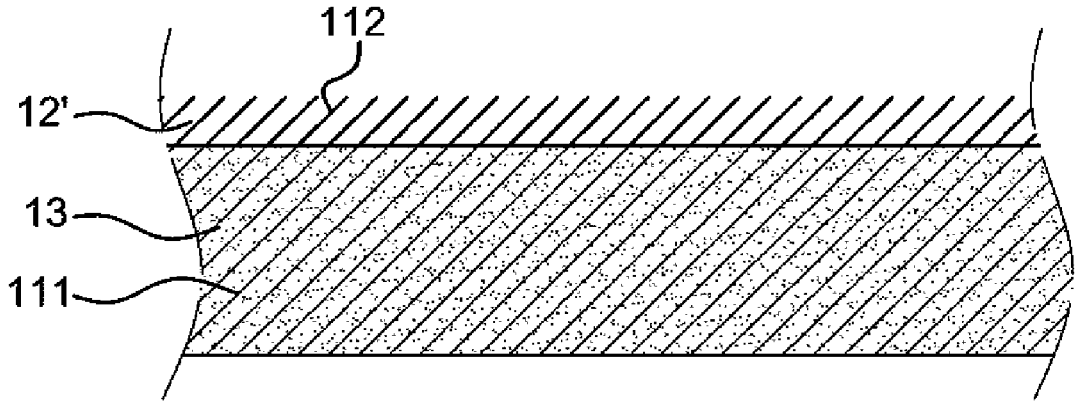
FIG. 4F shows a polishing pad after grinding the non-woven fabric of FIG. 4E.

According to a method of an example for making the polishing pad according to the preferred teachings of the present invention shown in FIG. 3, at A1, ultrafine fiber-generating fibers 11 are made into a non-woven fabric 1 (FIG. 3A). At A2, a side of the non-woven fabric 1 is heated at 120 degrees Celsius to form an outer, dense layer 12 (FIG. 3B). At A3, the non-woven fabric 1 is impregnated with a polymer 13 such as polyurethane resin to form a thin sheet (FIG. 3C). At A4, the ultrafine fiber-generating fibers 11 in the non-woven fabric 1 (the thin sheet) are converted into ultrafine fiber bundles 111 (FIG. 3D). At A5, the dense layer 12 of the non-woven fabric 1 is ground so that a polishing pad is formed with a polishing layer that includes nap 112 less than 0.05 dtex (FIG. 3E). The dense layer 12 remains a high concentration of fiber. According to a method of a second example for making the polishing pad according to the preferred teachings of the present invention shown in FIG. 4, at B1 ultrafine fiber-generating fibers 11 are made into a non-woven fabric 1 (FIG. 4A). At B2, a gravure roll is used to coat a side of the non-woven fabric 1 with a water solution containing 5% to 15% by weight of a water soluble substance 14 such as methyl cellulose at 100 to 200 g/m$^2$. The side of the non-woven fabric 1 is, thus, made dense to form a dense layer 12' (FIG. 4B) in order to prevent polymers from penetrating the non-woven fabric 1. At B3, the non-woven fabric 1 is impregnated with a polymer 13 such as polyurethane resin to form a thin sheet (FIG. 4C). At B4, the non-woven fabric 1 is washed in order to remove the water soluble substance 14 (FIG. 4D). At B5, the ultrafine fiber-generating fibers 11 in the non-woven fabric 1 (the thin sheet) are converted into ultrafine fiber bundles 111 (FIG. 4E). At B6, the dense layer 12' of the non-woven fabric 1 is ground so that a polishing pad is formed with a polishing layer that includes nap 112 less than 0.05 dtex (FIG. 4F). The dense layer 12' still includes a high concentration of fiber.

Conclusively, the polishing pad according to the preferred teachings of the present invention includes a body having a polymer layer having opposite first and second faces and a polishing layer on the first face of the polymer layer. The polymer layer includes a plurality of first ultrafine fibers and a polymer bonding the first ultrafine fibers together. The polishing layer includes a plurality of second ultrafine fibers. The first and second ultrafine fibers are identical to each other. The second ultrafine fibers have a first concentration of ultrafine fibers by volume to a total volume of the polishing layer. The first ultrafine fibers of the polymer layer have a second concentration of ultrafine fibers by volume to a total volume of the polymer layer. The first concentration is higher than the second concentration.

Figure 1:
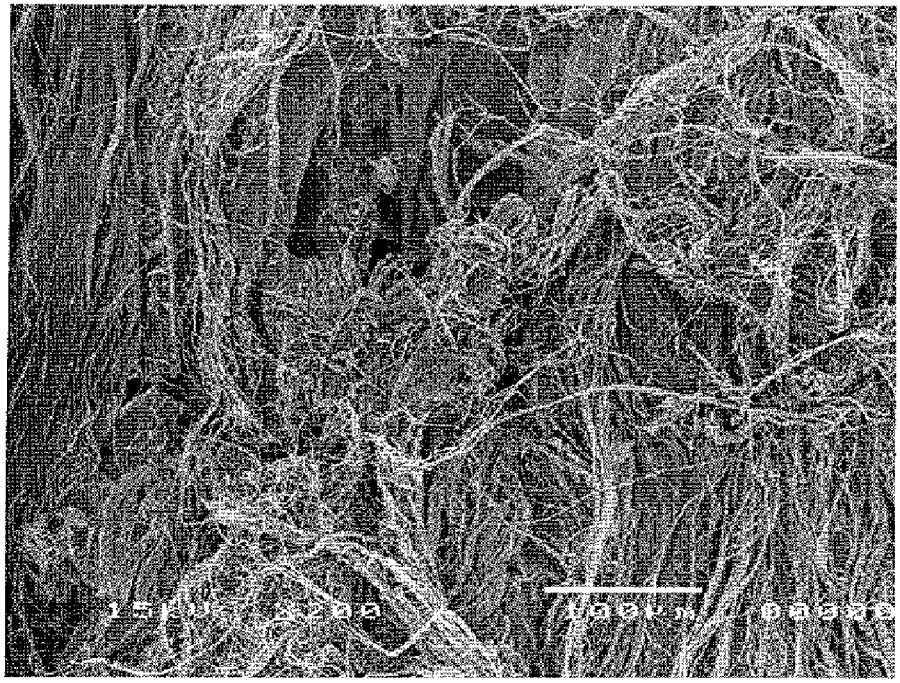
Fig.1 PRIOR ART
FIG. 1 is a SEM view of a conventional polishing pad.
Figure 2:
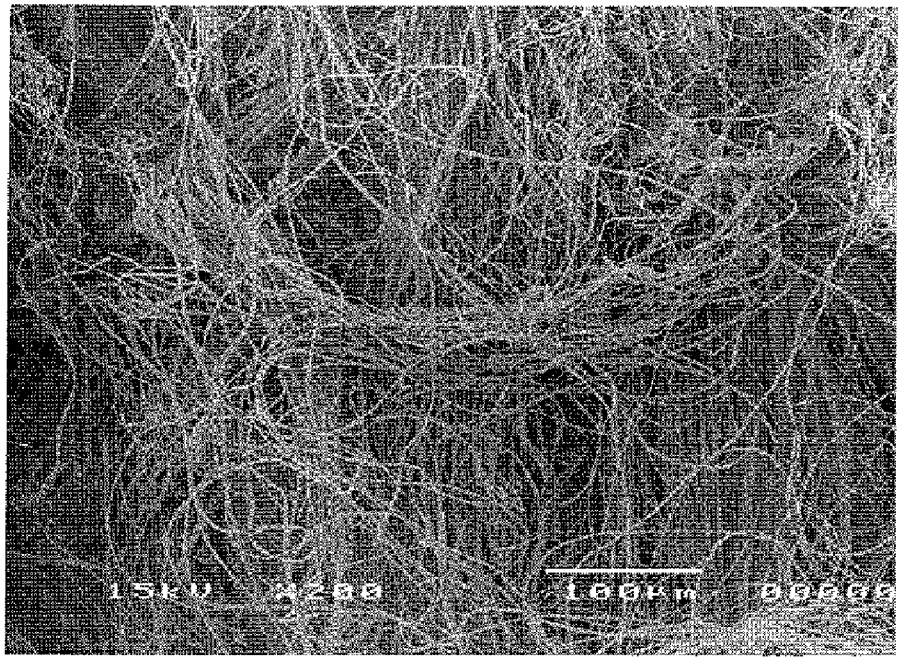
FIG. 2 is a SEM view of the polishing pad according to the preferred embodiment of the present invention.

Referring to FIG. 2, there is shown a polishing pad according to the preferred teachings of the present invention. The nap on the polishing layer is even and dense. The concentration of fiber of the dense layer is higher than 80%. On the contrary, referring to FIG. 1, the concentration of polyurethane of a polishing pad made in a conventional method is 45% to 50%. The concentration of polyurethane of the polishing pad of the present invention is 30% which is less than that of the conventional polishing pad. The polishing pad according to the preferred teachings of the present invention is more flexible and hangs better than the conventional polishing pad. The polishing pad according to the preferred teachings of the present invention makes fewer scratches than the conventional polishing pad. The scratches made by the polishing pad according to the preferred teachings of the present invention are lower than $1000/\mu m^2$. The scratches made by the conventional polishing pad are $2000/\mu m^2$ to $25000/\mu m^2$.

It is noted that the ultrafine fiber-generating fibers may be conjugate fibers or composite fibers.

The present invention has been described by the detailed description of the embodiments. Those skilled in the art can derive variations from the embodiments without departing from the scope of the present invention. Therefore, the embodiments shall not limit the scope of the present invention defined in the claims.

The invention claimed is:

1. A polishing pad comprising a body including a polymer layer and a polishing layer, with the polymer layer having opposite first and second faces, with the polymer layer including a plurality of first ultrafine fibers and a polymer bonding the plurality of first ultrafine fibers together, with the polishing layer being formed on the first face of the polymer layer and free of the polymer, with the polishing layer including a plurality of second ultrafine fibers, with the plurality of first and second ultrafine fibers being identical to each other, with the plurality of second ultrafine fibers having a first concentration of ultrafine fibers by volume higher than 80% of a total volume of the polishing layer, with the plurality of first ultrafine fibers of the polymer layer having a second concentration of ultrafine fibers by volume to a total volume of the polymer layer, wherein the first concentration is higher than the second concentration.

2. The polishing pad according to claim 1, with the plurality of second ultrafine fibers in the polishing layer having a fineness lower than 0.05 dtex.

* * * * *